US005360068A

United States Patent [19]

Sprunt et al.

[11] Patent Number: 5,360,068

[45] Date of Patent: Nov. 1, 1994

[54] FORMATION FRACTURING

[75] Inventors: Eve S. Sprunt, Farmers Branch; Alfred R. Jennings, Plano, both of Tex.; Robert S. Timmer, Bakersfield, Calif.

[73] Assignee: Mobil Oil Corporation, Fairfax, Va.

[21] Appl. No.: 47,983

[22] Filed: Apr. 19, 1993

[51] Int. Cl.[5] ..... E21B 43/24

[52] U.S. Cl. ..... 166/259; 166/308

[58] Field of Search ..... 166/259, 260, 308

[56] References Cited

U.S. PATENT DOCUMENTS

| | | | |
|---|---|---|---|
| 2,771,140 | 11/1956 | Barclay et al. | 166/60 |
| 3,708,206 | 1/1973 | Hard et al. | 299/5 |
| 3,858,658 | 1/1975 | Strubhar et al. | 166/308 |
| 3,980,136 | 9/1976 | Plummer et al. | 166/280 |
| 3,981,362 | 9/1976 | Allen et al. | 166/259 X |
| 4,474,237 | 10/1984 | Shu | 166/261 |
| 4,617,997 | 10/1986 | Jennings, Jr. | 166/299 |

*Primary Examiner*—William P. Neuder
*Attorney, Agent, or Firm*—Alexander J. McKillop; George W. Hager, Jr.

[57] ABSTRACT

An oxygenated foam is injected into a hydrocarbon-bearing reservoir within a diatomite-containing subsurface formation to hydraulically form a fracture within the reservoir. Combustion is initiated between the oxygenated foam and hydrocarbons within the reservoir to burn the formation and alter diatomite within the burned area into a hardened, more highly permeable material. The reservoir may again be fractured to shatter the hardened diatomite to further increase reservoir permeability and form a self-propped fracture within the reservoir.

9 Claims, 1 Drawing Sheet

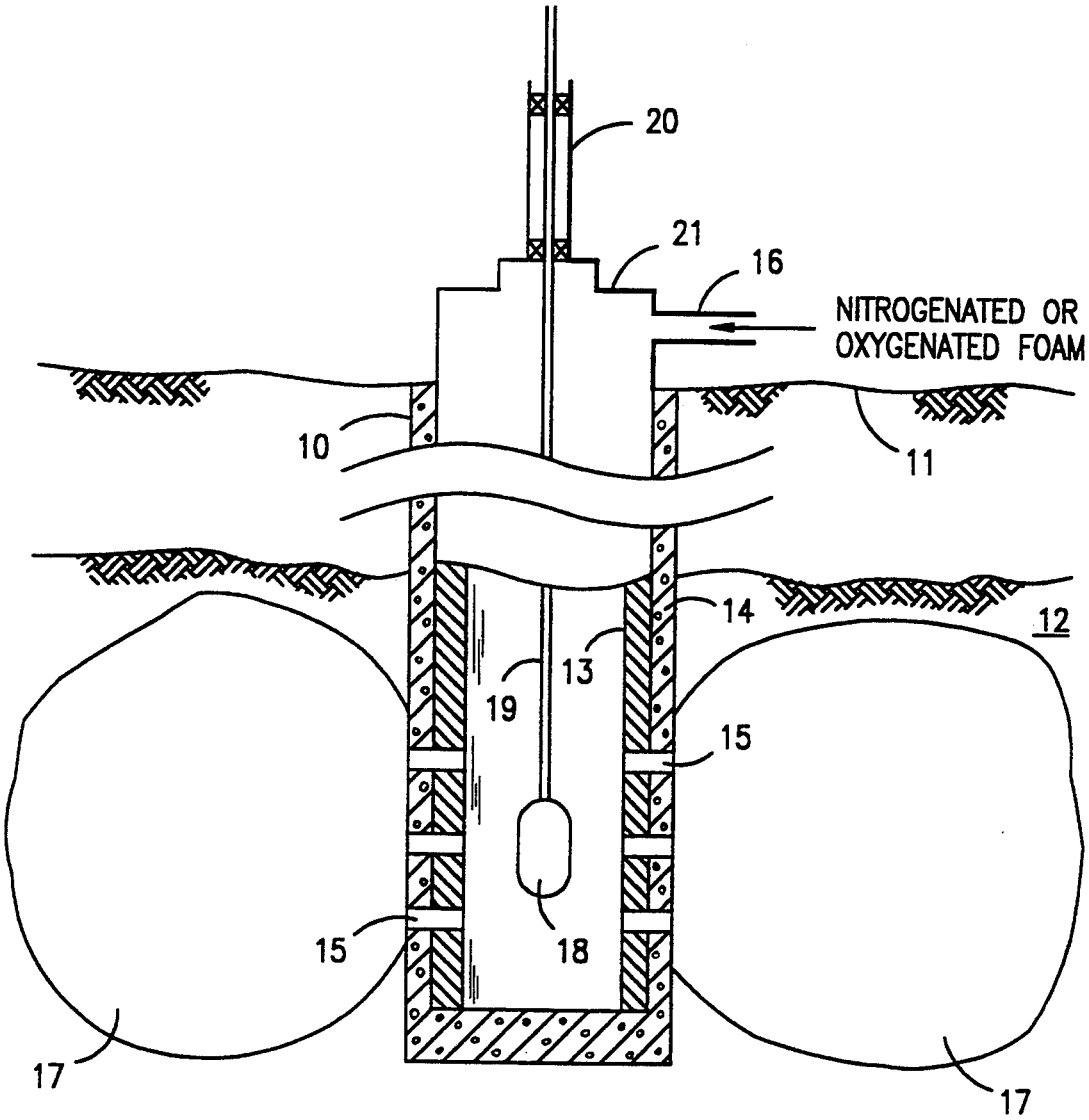
20
21
16
NITROGENATED OR
OXYGENATED FOAM
10
11
14
12
13
19
15
15
18
17
17

FORMATION FRACTURING

BACKGROUND OF THE INVENTION

This invention relates to the treatment of a subterranean formation in order to increase its permeability and, more particularly, to a hydraulic fracturing treatment of the formation with oxygenated foam as the fracturing fluid followed by in-situ combustion between the oxygenated foam and hydrocarbons with the formation.

It is oftentimes desirable to treat subterranean formations in order to increase the permeability thereof. For example, in the oil industry, it is conventional to hydraulically fracture a well in order to produce one or more fractures in the surrounding formation and thus facilitate the flow of oil and/or gas into the well or the injection of fluids such as gas or water from the well into the formation. Such hydraulic fracturing is accomplished by disposing a suitable fracturing fluid within the well opposite the formation to be treated. Thereafter, sufficient pressure is applied to the fracturing fluid in order to cause the formation to break down with the attendant formation of one or more fractures therein. Simultaneously with or subsequent to the formation of the fracture a suitable carrier fluid having suspended therein a propping agent such as sand or other particulate material is introduced into the fracture. The propping agent is deposited in the fracture and functions to hold the fracture open after the fluid pressure is released. The propped fracture provides larger flow channels through which an increased quantity of a hydrocarbon can flow, thereby increasing the production capabilities of a well.

A traditional fracturing technique utilizes a water or oil-based fluid to fracture a hydrocarbon-bearing formation. This technique is described in, for example, U.S. Pat. No. 3,858,658 to Strubhar et al.

Another successful fracturing technique has been that known as "foam fracturing". This process is described in, for example, U.S. Pat. No. 3,980,136 to R. A. Plummer et al. Briefly, that process involves generation of a foam which then is introduced through a wellbore into a formation which is to be fractured. Various gases and liquids can be used to create the foam, but foams generally used in the art are made from nitrogen and water in the presence of a suitable surfactant. The pressure at which the foam is pumped into the well is such that it will cause a fracture of the hydrocarbon-bearing formation. Additionally, the foam comes out of the well easily when the pressure is released from the wellhead, because the foam expands when the pressure is reduced.

SUMMARY OF THE INVENTION

In accordance with the present invention there is provided a method for fracturing a hydrocarbon-bearing reservoir, particularly within a diatomite-containing subterranean formation penetrated by a well. A combustible fracturing fluid, preferably an oxygenated foam, is injected through the well and into the diatomite-containing formation to hydraulically form a fracture within the reservoir. Combustion is initiated between the oxygenated foam and hydrocarbons within the reservoir to burn the formation adjacent the fracture and alter diatomite within the burned formation into a hardened, more highly permeable material.

The burn of the formation adjacent the fracture may be increased by increasing the oxygen content of the fracturing foam during combustion. This additional oxygen is pumped into the fracture during combustion. Further, the burn of the formation may be decreased by decreasing the oxygen content of the foam during combustion. This may be carried out by pumping nitrogen into the fracture during combustion.

In another aspect, the oxygenated foam may comprise a hydrocarbon base fluid which adds to the volatility of the foam.

In a yet further aspect, the hydrocarbon-bearing reservoir is fractured a second time to shatter the diatomite within the formation hardened during the first hydraulic fracturing to further increase the permeability of the reservoir and to form a self-propped fracture within the reservoir. This second fracturing of the reservoir is carried out with a non-oxygenated foam such as a nitrogenated foam, to avoid recombustion of the reservoir and to avoid loading the formation with water.

BRIEF DESCRIPTION OF THE DRAWING

The sole figure of drawings illustrates a subsurface hydrocarbon reservoir being fractured in accordance with the method of the present invention.

DESCRIPTION OF THE PREFERRED EMBODIMENT

For a description of the fracturing method of the present invention, reference is made to the drawing where there is shown a well 10 which extends from the surface of the earth 11 and penetrates a subterranean formation 12 which may contain, for example, a hydrocarbon-bearing reservoir. The well 10 includes a casing 13 which is cemented into place by a cement sheath 14. Perforations 15 are provided through the casing 13 and cement sheath 14 to open communication between the interior of the well 10 and the subterranean formation 12.

A combustible fracturing fluid, preferably an oxygenated foam, is pumped under hydraulic pressure into the well 10 by way of port 16 and out through the perforations 15 into the formation 12 surrounding the well to propagate the fracture 17 outwardly from the well 10 into the formation 12. Combustion is then initiated between the oxygenated foam and hydrocarbons contained within the fractured formation 12 to effect a burning of the formation adjacent the fracture. This burning is particularly effective on certain siliceous minerals and hydrated clays found in a diatomite-containing formation for altering the diatomite adjacent to the fracture into a hardened, more highly permeable material.

Permeability measurements on diatomite plug samples showed that post-burn permeability was increased from around 1 md to around 60 to 80 md. Porosity measurements on the samples indicated a post-burn porosity of around 48%. The diatomite in the burned zone is thus transformed from a soft material (opal-A) in which proppants are easily embedded, into a hardened, or brittle, material (opal-CT) with higher permeability.

Only a limited portion of the reservoir is thus burned, but in a way in which heat is transferred deep into the formation away from the well. Water, with its potentially disadvantageous relative permeability effects, is not introduced into the formation.

At the tip of a conventional fracture, where the fracture is one or two sand grains thick, the sand grains may become so embedded in soft opal-A diatomite that the permeability of the hydraulic fracture is much lower than in a harder formation in which the sand grains do not become embedded.

Most foams used for fracturing a formation range from about 65 to 90 quality (65–90% gas) because foams in this range are fairly stable. It may be desirable to start out with a given quality oxygen foam and then increase or decrease the oxygen content near the end of the burn treatment to effect an increase or decrease in the burn. Air could be used in place of oxygen as the internal phase of the foam. Nitrogen could be used to dilute the oxygen content and to help tailor the treatment by maintaining a given quality foam (i.e. percentage gas) if desired. The foam could further be prepared using hydrocarbons (e.g. diesel) as the base fluid which would add to the volatility of the foam and would greatly increase the safety aspects and concerns for the treatment.

The combustion step is initiated downhole adjacent the formation 12 to be fractured by the combustion igniter 18 suspended within the well 10 from the surface 11 by means of the conduit 19 set through a high pressure lubricator 20 at the wellhead 21. Any of several well-known types of downhole igniters may be utilized, for example, U.S. Pat. No. 2,771,140 to Barclay et al. discloses an electrical igniter, U.S. Pat. No. 4,474,237 to W. R. Shu discloses a gas-fired burner and U.S. Pat. No. 4,617,997 to A. R. Jennings, Jr. discloses a cannister having an ignitable propellant, the teachings of each of which are incorporated herein by reference.

An additional feature of the present invention is to follow the initial fracturing and combustion steps with a second hydraulic fracturing of the formation to shatter the diatomite material within the formation hardened from the burn of the combustion step. This produces an even higher permeability, self-propped fracture. Although the burn increased the permeability of the diatomite material by about two orders of magnitude, a second fracturing of the formation further increases its permeability. This second, or post combustion fracturing, may preferably be carried out with a non-oxygenated foam to avoid recombustion and to avoid loading the formation with water. A suitable example would be a nitrogenated foam.

There has now been described and illustrated herein a method for fracturing a hydrocarbon-bearing reservoir within a diatomite containing subterranean formation penetrated by a well. However, those skilled in the art will recognize that many modifications and variations besides those specifically set forth may be made in the techniques described herein without departing from the spirit and scope of the invention as set forth in the appended claims.

We claim:

1. An in-situ method for creating a self-propped fracture in a hydrocarbon-bearing reservoir within a diatomite-containing subterranean formation penetrated by a well, comprising the steps of:

a) creating a fracture within said reservoir, b) initiating combustion within said reservoir to burn the reservoir adjacent said fracture and harden the formation adjacent the fracture so as to increase the permeability of said reservoir to the point of being able to be shattered, and c) shattering the formation hardened during the fracturing of said reservoir to create in-situ proppants for forming a self-propped fracture within said reservoir.

2. The hydraulic fracturing method of claim 1 wherein the step of shattering the hardened formation is carried out by hydraulically fracturing said reservoir with a non-oxygenated foam to avoid re-combustion of the reservoir and to avoid loading the formation with water.

3. The hydraulic fracturing method of claim 2 wherein said non-oxygenated foam is a nitrogenated foam.

4. The method of claim 1 wherein the steps of creating a fracture and initiating combustion are carried out in accordance with the following steps:

a) injecting a combustible fracturing fluid through said well and into said diatomite-containing formation to hydraulically form a fracture within said reservoir; and b) initiating combustion between said fracturing fluid and hydrocarbons to burn the reservoir adjacent said fracture and alter said reservoir into a hardened, more highly permeable material.

5. The hydraulic fracturing method of claim 4 further comprising the step of increasing burn of the formation adjacent said fracture by increasing the oxygen content of said fracturing fluid during combustion.

6. The hydraulic fracturing method of claim 4 further comprising the step of decreasing burn of the formation adjacent said fracture by decreasing the oxygen content of said fracturing fluid during combustion.

7. The hydraulic fracturing method of claim 6 wherein nitrogen is pumped into said fracture during combustion.

8. The hydraulic fracturing method of claim 4 wherein said fracturing fluid is an oxygenated foam.

9. The hydraulic fracturing method of claim 8 wherein said oxygenated foam comprises a hydrocarbon base fluid which adds to the volatility of said foam.

* * * * *